US007119769B2

(12) United States Patent
Abe et al.

(10) Patent No.: US 7,119,769 B2
(45) Date of Patent: Oct. 10, 2006

(54) ACTIVE MATRIX TYPE ORGANIC EL PANEL DRIVE CIRCUIT AND ORGANIC EL DISPLAY DEVICE

(75) Inventors: Shinichi Abe, Kyoto (JP); Masanori Fujisawa, Kyoto (JP); Jun Maede, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 411 days.

(21) Appl. No.: 10/636,555

(22) Filed: Aug. 8, 2003

(65) Prior Publication Data

US 2004/0032217 A1 Feb. 19, 2004

(30) Foreign Application Priority Data

Aug. 13, 2002 (JP) ..... 2002-235518

(51) Int. Cl.
*G09G 3/30* (2006.01)

(52) U.S. Cl. ..... 345/76; 345/84

(58) Field of Classification Search ..... 345/76, 345/77, 78, 84, 204, 589, 590, 605; 315/169.1, 315/169.3; 348/800
See application file for complete search history.

(56) References Cited

U.S. PATENT DOCUMENTS

2003/0184504 A1* 10/2003 Abe ..... 345/76
2004/0155840 A1* 8/2004 Abe et al. ..... 345/76
2004/0218105 A1* 11/2004 Hulshof et al. ..... 348/767
2005/0029968 A1* 2/2005 Shimoda ..... 315/293
2005/0073486 A1* 4/2005 Maede et al. ..... 345/76

FOREIGN PATENT DOCUMENTS

| | | |
|---|---|---|
| JP | 62-122488 | 6/1987 |
| JP | 10-112391 | 4/1998 |
| JP | 2000-81920 | 3/2000 |
| JP | 2001-290457 | 10/2001 |
| WO | 02/39420 | 5/2002 |

* cited by examiner

*Primary Examiner*—Vijay Shankar
*Assistant Examiner*—Nitin Patel
(74) *Attorney, Agent, or Firm*—Mattingly, Stanger, Malur & Brundidge, P.C.

(57) ABSTRACT

A drive circuit of an active matrix type organic EL display panel includes a drive current generator circuit for generating drive currents corresponding to the red, green and blue colors in a predetermined sequence in response to a RGB switching signal and a current switching circuit having a first, second and third output terminals corresponding to the respective red, green and blue colors, the current switching circuit adapted to select one of the first, second and third output terminals in the predetermined sequence in response to the RGB switching signal, generate currents for charging the capacitors of the pixel circuits for the red, green and blue colors in response to the drive currents and output the charging current to the output terminals.

15 Claims, 3 Drawing Sheets

ACTIVE MATRIX TYPE ORGANIC EL PANEL DRIVE CIRCUIT AND ORGANIC EL DISPLAY DEVICE

BACKGROUND OF THE INVENTION

1. Field of the Invention

The present invention relates to an active matrix type organic EL drive circuit and an organic EL display device using the same drive circuit and, in particular, the present invention relates to an active matrix type organic EL display device of a portable telephone set or a PHS, etc., which is capable of reducing a mounting area of drivers for an active matrix type organic EL display panel and improving luminance of organic EL elements and which is suitable for a high luminance color display.

2. Description of the Prior Art

It has been known that an organic EL display device, which realizes a high luminance display by spontaneous light emission, is suitable for a display on a small display screen and the organic EL display device has been attracting public attention as the next generation display device to be mounted on a portable telephone set, a PHS, a DVD player or a PDA (Personal Digital Assistants), etc. Known problems of such organic EL display device are that luminance variation thereof becomes substantial when it is driven by voltage as in a liquid crystal display device and that, since there is difference in sensitivity of organic EL element between R (red), G (green) and B (blue) display colors, a control of luminance of a color display becomes difficult.

In view of these problems, an organic EL display device using current drive circuits has been proposed recently. For example, JPH10-112391A discloses a technique in which the luminance variation problem is solved by employing a current drive system.

An organic EL display panel of an organic EL display device for a portable telephone set, a PHS, etc., having 396 (=132×3) terminal pins for column lines and 162 terminal pins for row lines has been proposed. However, there is a tendency that the number of column lines as well as row lines is further increased.

An output stage of a current drive circuit of such organic EL display panel of either the active matrix type or the passive matrix type includes a current source drive circuit, for example, an output circuit constructed with a current mirror circuit.

In the active matrix type organic EL display panel, a pixel circuit composed of a capacitor and a transistor is provided for each display cell (pixel). An organic EL element (referred to as "OEL element", hereinafter) is current-driven by the transistor of the pixel circuit, which is driven correspondingly to a voltage stored in the capacitor thereof. The drive system is either a digital drive system in which the drive current of the OEL element is binary-controlled or an analog control in which the drive current is controlled by an analog input data. In the case of the digital drive system, a display area of a pixel is controlled by providing a sub pixel in the pixel or the color tone of the display element is controlled by dividing a light emitting time. In the case of the analog drive system, there are a voltage setting type (voltage program system) and a current setting type (current program system). In the voltage setting type system, a terminal voltage of the capacitor of each pixel circuit is set according to a voltage signal and, in the current setting type system, the terminal voltage of the capacitor is set according to a current signal.

Incidentally, in order to restrict luminance variation, a current drive circuit of a passive matrix type organic EL display panel uses current having a peak with which the OEL element having a capacitive load characteristics is initially charged to emit light earlier. On the other hand, in the active matrix type organic EL display panel, a voltage corresponding to a drive current is temporarily written in the capacitor of the pixel circuit and then the drive current corresponding to the written voltage of the capacitor is generated. Therefore, the OEL element of the active matrix type organic EL panel is not driven by a peak current. The OEL element is driven in a sequence of the write of the drive current value and then the light is emitted. That is, the write period is necessary before the light emission period. As a result, there are problems that the earlier light emission as that in the passive matrix type organic EL panel is impossible and the light emission period becomes shorter than that in the passive matrix type organic EL panel.

The writing of the drive current is usually performed by charging the capacitor of the pixel circuit, which usually has a capacitance of several hundreds pF, with a current of about 0.1 μA to 10 μA and the time required to write the drive current becomes as long as about 10% or more of a scan period. The light emitting time is reduced correspondingly, resulting in reduction of display luminance. Particularly, when the number of display pixels is increased as in VGA, SVGA or XGA, etc., in which the time control must be performed within a limited time, the previously mentioned defect becomes serious.

Further, in a case where, in order to perform a high luminance color display with pixel density as high as VGA, SVGA or XGA, etc., OEL elements of an active matrix type organic EL display panel are current-driven by drive circuits provided externally of the organic EL display panel, an area of the display panel in which the drive circuits are mounted becomes large since the number of drive circuits for R, G and B display colors, which are provided in a peripheral portion of the organic EL display panel, is very large.

In order to reduce the mounting area of the drivers in such as a liquid crystal display device, one drive circuit is provided for R, G and B pixels and pixel circuits are driven in time-division. This is realized by selecting the R, G and B pixels in a sequence and voltage-driving the sequentially selected pixels through an analog switch (transmission gate). When such analog switch system is applied to the current-drive of the active matrix type OEL elements, the voltage drop in the analog switch becomes large, so that it is impossible to generate precise drive current.

SUMMARY OF THE INVENTION

An object of the present invention is to provide a drive circuit of an active matrix type organic EL display panel, which is capable of reducing the mounting area of drivers for the active matrix type organic EL display panel and improving luminance of the OEL elements and which is suitable for high luminance color display and an organic EL display device using the same drive circuits.

In order to achieve the above object, according to a first aspect of the present invention, the drive circuit of an active matrix type organic EL display panel is featured by comprising a plurality of drive current generator circuits for generating drive currents corresponding to the respective R, G and B display colors in a predetermined sequence in response to a RGB switch signal and a current switching circuit having a first, second and third output terminals corresponding to the respective R, G and B display colors.

The current switching circuit adapts to select one of said first, second and third output terminals in the predetermined sequence in response to the RGB switching signal, generate currents for charging said capacitors of said pixel circuits for the red, green and blue colors in response to the drive currents and output the charging current to said output terminals.

As mentioned above, since the current switching circuit generates the currents for charging the capacitors of the respective R, G and B pixel circuits, which store the drive current values, in time-division according to the RGB switching signal, in response to the drive current from one of the drive current generator circuits, the number of the current drive circuits becomes substantially one-third that of the conventional panel of the analog system. Further, since the charging current of the capacitor of the pixel circuit is generated by the current switching circuit, such voltage drop as in the analog switch (transmission gate) does not occur. Therefore, it is possible to generate the charging current having precise current value.

Further, since the operation for writing the drive current values for R, G and B pixels can be performed in sequence without employing the write-emission sequence, it is possible to overlap R, G and B light emission periods, so that the light emission drive period for OEL elements of R, G and B display colors can be made longer. Further, it is possible to write all of R, G and B data at high speed at once, so that a total write time of R, G and B data can be reduced and the light emission period can be increased correspondingly thereto.

As a result, it is possible to realize a drive circuit of an active matrix type organic EL display panel, which is capable of reducing the mounting area of the drivers of the organic EL display panel and of improving luminance of the OEL elements, and an organic EL display device.

DETAILED DESCRIPTION OF THE PREFERRED EMBODIMENTS

Figure 1:
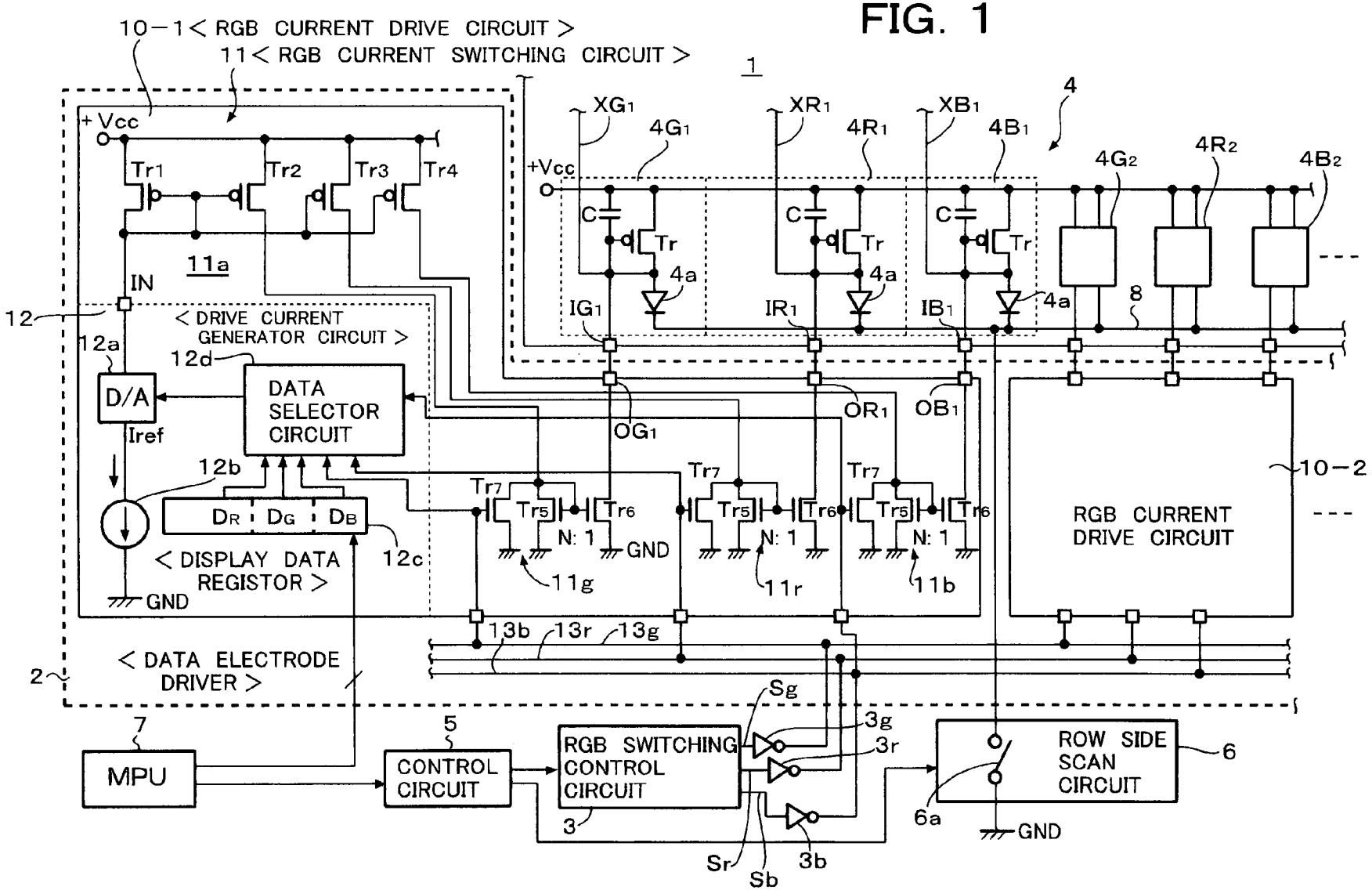
FIG. 1 is a block circuit diagram of an active matrix type organic EL display device according to an embodiment of the present invention.

FIG. 1 shows an organic EL display panel 1 of an active matrix type organic EL display device, which is constructed with a data electrode driver 2, a RGB switching control circuit 3, pixel circuits 4, a control circuit 5, a row side scan circuit 6 and a MPU 7, etc.

Although the pixel circuits 4 are provided at cross points of an X-Y matrix, respectively, internal circuits of only pixel circuits 4G1, 4R1 and 4B1 for R, G and B display colors are shown in FIG. 1. Pixel circuits 4R2, 4G2 and 4B2, . . . , succeed the pixel circuits 4R1, 4G1 and 4B1 to constitute a horizontal line. Since internal circuits of the pixel circuits 4R2, 4G2 and 4B2, etc., are identical to those of the pixel circuits 4R1, 4G1 and 4B1, details thereof are not shown.

Although the pixel circuits 4G1, 4R1 and 4B1 are described in the following description, the pixel circuits are provided correspondingly to R, G and B pixels in the horizontal direction, respectively.

Data lines XG1, XR1 and XB1, . . . , are portions of respective data lines (or lines connected to respective column pins) provided correspondingly to the pixels in the horizontal direction (column direction) and are connected to the pixel circuits 4G1, 4R1 and 4B1, respectively. A number of pixel circuits, which are not shown and arranged in a vertical direction (row direction), are also connected to the data lines XG1, XR1 and XB1, respectively. Incidentally, a reference numeral **4*a*** depicts an OEL element provided in each pixel circuit.

The data electrode driver 2 includes RGB current drive circuits 10-1, 10-2, . . . . The RGB current drive circuits 10-1, 10-2, . . . , are the so-called column driver (driver in horizontal scan direction) of the organic EL drive circuit and each RGB current drive circuit has input terminals connected to the R, G and B data lines, respectively, and output terminals connected to the R, G and B pixel circuits 4G, 4R and 4B, respectively. Therefore, the number of the RGB current drive circuits 10-1, 10-2, . . . , having identical constructions is one-third the total number of the R, G and B data lines. In other words, each RGB current drive circuit is commonly used by one pixel circuit including the R, G and B pixels and the RGB current drive circuits are provided correspondingly in number to the pixel units in the respective horizontal R, G and B scan direction.

A relation between the pixel circuits 4G1, 4R1 and 4B1 and the RGB current drive circuit 10-1 will be described in detail.

Each of the pixel circuits 4G1, 4R1 and 4B1 is composed of a P channel MOS transistor Tr having a drain connected to an anode side of the OEL element **4*a* and a source connected to a power source line +Vcc and a capacitor C, which is connected between a gate of the transistor Tr and the power source line +Vcc and functions to store a voltage value corresponding to a value of the drive current. The gates of the transistors Tr of the pixel circuits 4G1, 4R1 and 4B1 are connected to the data lines XG1, XR1 and XB1**, respectively.

The data lines XG1, XR1 and XB1 are connected to respective input terminals IG1, IR1 and IB1, which are connected to respective output terminals OG1, OR1 and OB1 of the RGB current switching circuits 11.

Cathode sides of the OEL elements **4*a* of one horizontal line are commonly connected to the switch circuit 6*a* of the row side scan circuit 6 through the row side line 8. The row side scan circuit 6 operates to turn the switch circuit 6*a* connected to the cathodes of the OEL elements 4*a* of the one horizontal scan line ON after the capacitors C of the pixel circuits of the one horizontal line are written with the voltages corresponding to the drive current values. Therefore, the OEL elements 4*a*** of the one horizontal scan line are simultaneously driven with the currents determined by the voltage values stored in the capacitors C, respectively.

A plurality of the switch circuits **6*a* corresponding in number to the vertical scan lines are provided in the row-side scan line 6. The switch circuits 6*a* are sequentially ON/OFF controlled correspondingly to the row-side scan (vertical scan) by turning one of the switch circuits 6*a* connected to the row-side scan line whose scan is over and a subsequent one of the switch circuits 6*a***, which is connected to the row-side scan line to be scanned next, OFF and ON, respectively.

The RGB current drive circuit 10-1 is composed of a RGB current switching/outputting circuit 11 and a drive current generator circuit 12. The RGB switching/outputting circuit 11 is composed of an input stage current mirror circuit 11*a* including P channel transistors Tr1, Tr2, Tr3 and Tr4 and output stage current switch circuits 11*g*, 11*r* and 11*b*, which are driven by the current mirror circuit 11*a*.

The transistor Tr1 is an input side transistor of the current mirror circuit 1*a* and the transistors Tr2, Tr3 and Tr4 are output transistors provided correspondingly to R, G and B pixels, respectively. Sources of all of these transistors are connected to the power source line +Vcc and a drain of the transistor Tr1 is driven by a drive current supplied from the drive current generator circuit 12 through an input terminal IN of the RGB current switching/outputting circuit 11. The current mirror circuit 11*a* generates a mirror current equal to the drive current at the drains of the output side transistors Tr2, Tr3 and Tr4 and supplies the mirror currents to the current switch circuits 11*g*, 11*r* and 11*b* provided for R, G and B pixels, respectively.

The current switch circuits 11*g*, 11*r* and 11*b* have identical constructions. Each of the current switch circuits 11*g*, 11*r* and 11*b* includes a current mirror output circuit composed of N channel MOS transistor Tr5 and N channel MOS transistor Tr6 which is current-mirror connected to the transistor Tr5, and a transistor Tr7, which is provided in parallel to the input side transistor Tr5. Sources of the transistors Tr5 to Tr7 are grounded. Incidentally, gate width ratio of the transistor Tr5 to the transistor Tr6 is N:1 (where N is an integer equal to or larger than 2) and the output currents to the output terminals OG1, OR1 and OB1 are made 1/N, respectively. Therefore, it is possible to reduce noise to thereby generate highly precise output currents. Further, in the current switching circuit, the drains of the input side transistor Tr5 and the transistor Tr7 are connected to each other so that these transistors are supplied with the common drive current. The input side transistor Tr5 is turned OFF when the transistor Tr7 is turned ON, so that the drive current of the input side transistor Tr5 is switched to the transistor Tr7. On the other hand, the input side transistor Tr5 is turned ON when the transistor Tr7 is turned OFF, so that the drive current of the input side transistor Tr7 is switched to the transistor Tr5.

In the current switch circuit 11*g*, the commonly connected drains of the transistors Tr5 and Tr7 are connected to the drain of the transistor Tr2 of the current mirror circuit 11*a* and supplied with the drive current from the transistor Tr2. The drain of the transistor Tr6 of the current switching/outputting circuit 11*g* is connected to the output terminal OG1 and outputs a charging current (current to be sunk) to the capacitor C of the pixel circuit 4G1 corresponding to the G pixel to the terminal OG1, correspondingly to the drive current inputted to the input terminal IN.

In the current switch circuit 11*r*, the commonly connected drains of the transistors Tr5 and Tr7 are connected to the drain of the transistor Tr3 of the current mirror circuit 11*a* and supplied with the drive current from the transistor Tr3. The drain of the transistor Tr6 of the current switch circuit 11*r* is connected to the output terminal OR1 and outputs a charging current (current to be sunk) to the capacitor C of the pixel circuit 4R1 corresponding to the R pixel to the terminal OR1, correspondingly to the drive current inputted to the input terminal IN.

In the current switch circuit 11*b*, the commonly connected drains of the transistors Tr5 and Tr7 are connected to the drain of the transistor Tr4 of the current mirror circuit 11*a* and supplied with the drive current from the transistor Tr4. The drain of the transistor Tr6 of the current switch circuit 11*b* is connected to the output terminal OB1 and outputs a charging current (current to be sunk) to the capacitor C of the pixel circuit 4B1 corresponding to the B pixel to the terminal OB1, correspondingly to the drive current inputted to the input terminal IN.

The gates of the transistors Tr7 of the current switch circuits 11*g*, 11*r* and 11*b* are supplied with switching control signals Sg, Sr and Sb from the RGB switching control circuit 3 through inverters 3*g*, 3*r* and 3*b* and control lines 13*g*, 13*r* and 13*b*, respectively. Since "L" level signals are supplied to the gates of the transistors Tr7 of the current switch circuits 11*g*, 11*r* and 11*b* by the inverters 3*r*, 3*r* and 3*b* when the switch control signals Sg, Sr and Sb are in "H" levels, the transistors Tr7 are turned OFF. On the other hand, when the switch control signals Sg, Sr and Sb are in "L" levels, the transistors Tr7 are turned ON.

Therefore, the currents flowing through the input side transistors Tr5 of the current mirror output circuits of the current switch circuits 11*g*, 11*r* and 1*b* are switched to the transistors Tr7 when the switch control signals Sg, Sr and Sb are "L" level, respectively, so that there is no output current in the output side transistor Tr6, which is current-mirror connected to the transistor Tr5. When the switch control signals Sg, Sr and Sb are "H" level, the transistors Tr7 are turned OFF, outputting the charging currents from the output side transistors Tr6, respectively.

Figure 2:
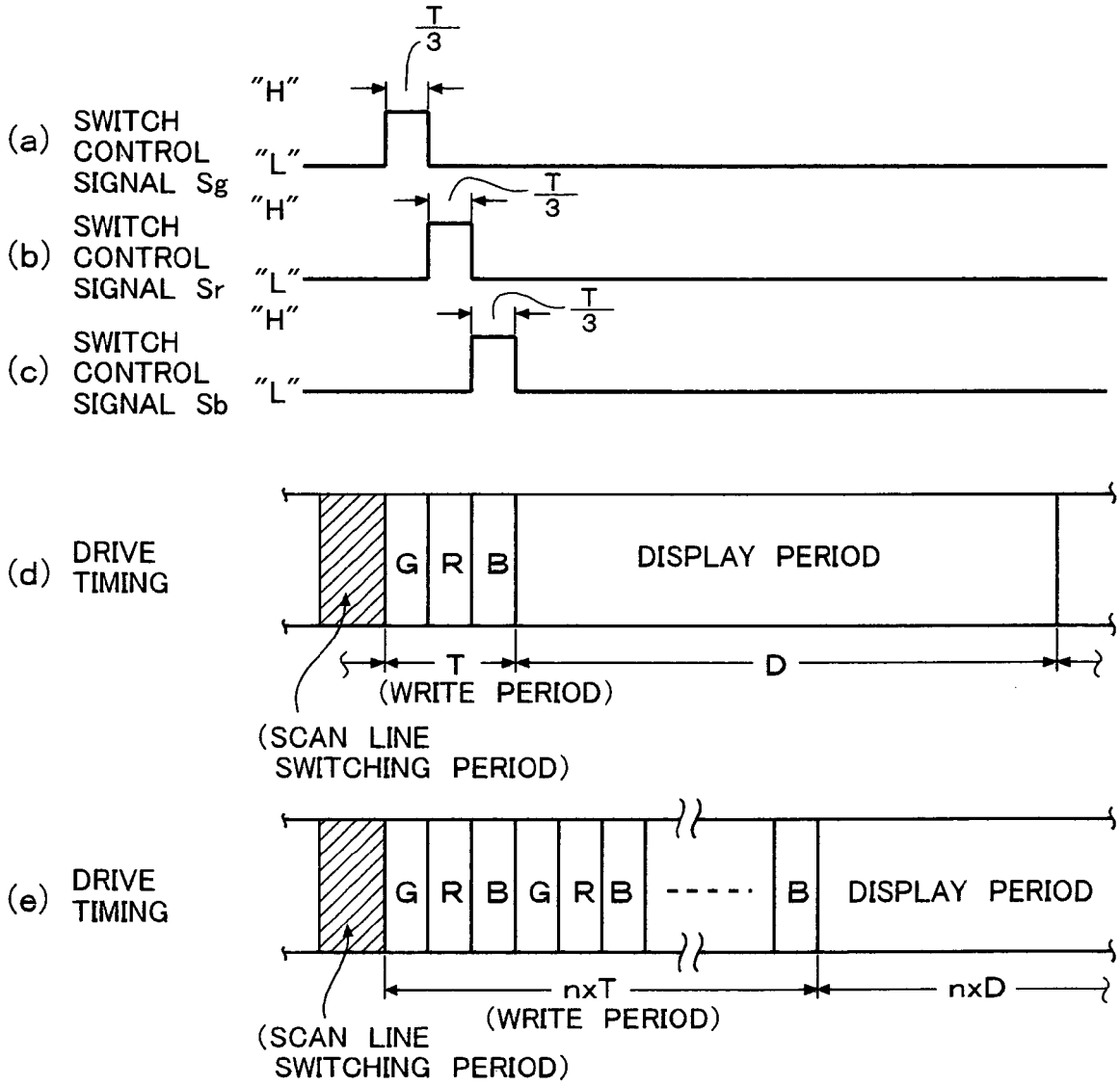
FIG. 2 illustrates a drive timing for R, G and B pixels in a RGB current switching circuit shown in FIG. 1.

As shown in FIG. 2, the switch control signals Sg, Sr and Sb become "H" level in a predetermined sequence corresponding to the drive timing of the R, G and B pixel circuits and, in this embodiment, the switch control signals become "H" level for a constant time period in the sequence from the G pixel through the R pixel to the B pixel. When the switch control signals Sg, Sr and Sb become "H" level in the above sequence, the output currents of the output side transistors Tr6 of the current switch circuits 11*g*, 11*r* and 11*b* appear sequentially at the output terminals connected to the transistors Tr6. The output circuits become the charging circuits for the capacitors C of the R, G and B pixel circuits, respectively.

Since the switch control signals Sg, Sr and Sb are supplied to the G pixel circuit, the R pixel circuit and the B pixel circuit, which constitute the display pixels, which are arranged in the horizontal scan direction and constitute one horizontal scan line, through the control lines 13*g*, 13*r* and 13*b*, respectively, the write of the drive current values for the capacitors C of the R, G and B pixel circuits for one horizontal scan line are performed simultaneously. Incidentally, the RGB switching control circuit 3 generates the switch control signals Sg, Sr and Sb under control of the control circuit 5.

The output currents of the current switch circuits 11*g*, 11*r* and 11*b* are determined by the drive currents inputted from the drive current generator circuit 12 to the input terminal IN of the RGB current switching/outputting circuit 11. The drive current generator circuit 12 is composed of a D/A converter circuit 12*a*, *a* reference current generator circuit 12*b*, *a* display data register 12*c* and a data selector circuit 12*d*.

The D/A converter circuit 12*a* is driven by a reference current Iref generated by the reference current generator circuit 12*b* and generates, on the basis of the reference current Iref, the drive currents corresponding to the display data supplied from the display data register 12*c*. The drive current thus generated is inputted to the input terminal IN.

The display data register 12*c* has memory domains DR, DG and DB corresponding to the R, G and B pixels, respectively, and the R, G and B color data in the R, G and B memory domains is selected by the data selector circuit 12*d* upon the switch control signals Sg, Sr and Sb supplied through the inverters 3*g*, 3*r* and 3*b*, respectively. The data selector circuit 12*d* selects one of the R, G and B data corresponding to one of the switch control signals Sg, Sr and Sb, which is "H" level, and sends the selected data to the D/A converter circuit 12*a*.

That is, the drive current generator circuit 12 selects one of the R, G and B display data when the corresponding one of the switch control signals Sg, Sr and Sb becomes "H" level (when the input signal to the data selector circuit 12*d* becomes "L" level), generates the drive current corresponding to the selected display data by the D/A converter circuit 12*a* and supplies the thus generated drive current to the input terminal IN of the RGB current switching/outputting circuit 11. As a result, the output currents for the R, G and B pixel circuits are generated at the R, G and B output terminals OG1, OR1 and OB1 with driving timing with which the switch control signals Sg, Sr and Sb become "H" level, respectively.

Incidentally, when all of the switch control signals Sg, Sr and Sb are "L" level, the input of the D/A converter circuit 12*a* becomes "0", so that no drive current is generated by the D/A converter circuit 12*a*. As a result, no current is generated by the current switch circuits 11*g*, 11*r* and 11*b*, so that substantial useless power consumption does not occur.

FIG. 2 is a drive timing chart in the RGB current switching/outputting circuit 11, in which a waveform (a) is the switch control signal Sg, (b) is the switch control signal Sr, (c) is the switch control signal Sb and (d) illustrates the drive timing.

The switch control signals Sg, Sr and Sb become "H" level in the sequence shown by the waveforms (a) to (c) during the write period T of the capacitors C. As shown in FIG. 2, the current switch circuits 11*g*, 11*r* and 11*b*, . . . , generate the charging currents for the G, R and B pixels in the horizontal scan direction in the shown sequence in time-division manner and the drive currents thus generated are written in the capacitors of the pixel circuits 4G1, 4R1 and 4B1, . . . , as voltage values, respectively. Thereafter, the row side switch circuits 6*a* to be scanned become ON for a display period D as shown by the timing (d). Thus, the OEL elements 4*a* of the pixel circuits 4G1, 4R1, 4B1, 4G2, 4R2, 4B2, . . . , included in one horizontal scan line are driven simultaneously in the display period D. Incidentally, a scan line switching period of the row side scan is provided immediately before the write period T as shown by a hatched region.

Since the drive current values for the capacitors C of the R, G and B pixel circuits 4 included in one horizontal scan line are stored in the capacitors C in time-division manner and, therefore, the write period T and the light emitting period D, which are provided for each of R, G and B pixels, are separated, it is possible to store the drive current values at high speed. Incidentally, although the write periods of the capacitors C of the G, R and B pixel circuits are commonly T/3, the write periods may be made different.

In this embodiment, it is possible to reduce the number of current drive circuits to one-third that in the conventional organic EL display panel to thereby reduce the mounting area of current drive circuits in the panel by performing the time-divisional write control, that is, by switching the current drive circuits of the R, G and B pixel circuits in time-division manner.

Incidentally, in the present invention, when the drive currents are stored in the capacitors C of the R, G and B pixel circuits in time-division manner, it is possible to group three pixel circuits for R, G and B colors as a unit, write drive current values of the units sequentially as voltage values and emit R, G and B color lights simultaneously. In such case, since, according to the present invention, the drive currents of every unit are stored sequentially, it is possible to increase the light emitting period by bringing the units together Further, since it is possible, in the present invention, to successively write the drive current values of the R, G and B pixels, the write period can be reduced compared with the case where the write period is provided for every pixel and the light emitting period can be increased.

Further, according to the present invention, it is possible to write drive current values in the capacitors C of the R, G and B pixel circuits of one screen sequentially in time-division manner and then to emit lights of the one screen simultaneously.

The timing (e) shown in FIG. 2 is an example of the drive period, which is n times that of the drive period shown by (d).

Assuming that a total number of R, G and B pixel circuits of one screen is n, the write period for writing the n capacitors C and the light emission of n OEL elements are separated from each other. As a result, the write period becomes n×T and the light emitting period becomes n×D.

Figure 3:
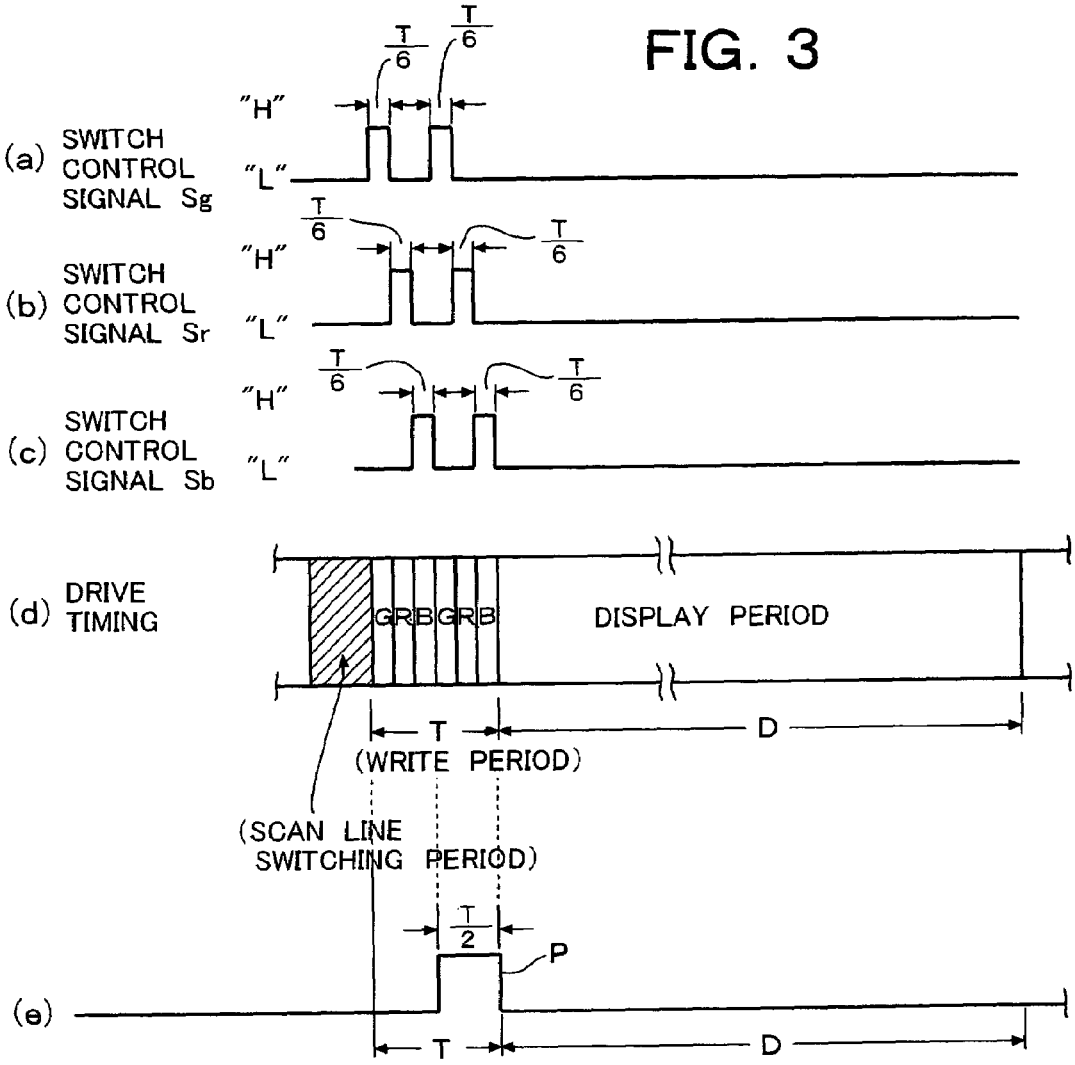
FIG. 3 illustrates a drive timing in a case where the write of the drive current values for R, G and B pixels in the R, G and B current switching circuit is performed twice for one horizontal scan line.

FIG. 3 shows an example of the drive timing in which the write of the drive current values of the R, G and B pixels is performed twice for one horizontal scan line.

Figure 4:
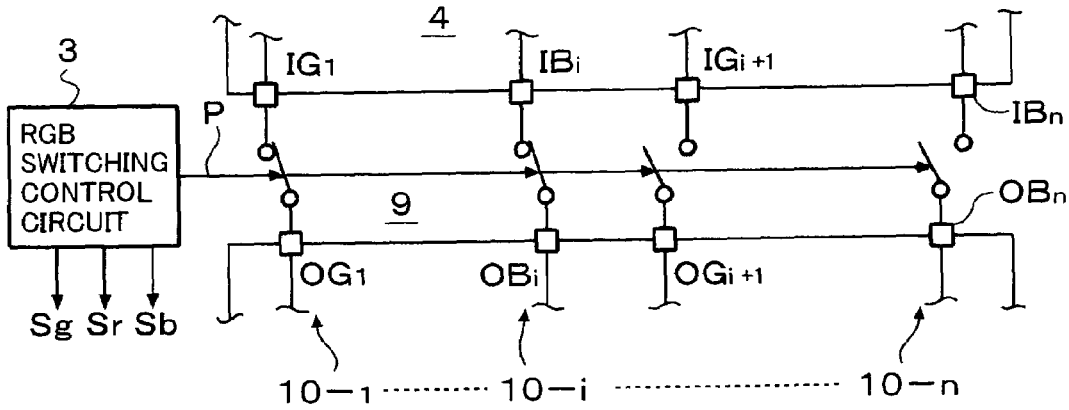
FIG. 4 is a circuit diagram of the switch circuit for performing the drive timing shown in FIG. 3.

In this embodiment, a horizontal scan line is divided by two and the write of the drive current values in the capacitors C of the R, G and B pixel circuits for the first half of the horizontal scan line is performed in the first half of the write period T. The write of the drive current values in the capacitors C of the R, G and B pixel circuits for the second half of the horizontal scan line is performed in the second half of the write period T. FIG. 4 shows a switch circuit 9 for realizing the above mentioned operation.

In FIG. 4, the switch circuit 9 includes switches provided between the output terminals OG1, OR1, OB1, . . . . , and the input terminals IG1, IR1, IB1, . . . , of the G, R and B pixel circuits shown in FIG. 1. The output terminals OG1 to OBi correspond to the first half of the horizontal scan line and the output terminals OGi+1 to OBn correspond to the second half of the scan line. In response to a pulse P, which is supplied from the RGB switching control circuit 3 and is "H" level in the second half of the write period T, the switches corresponding to the output terminals OG1 to OBi are ON during the first half of the write period T, in which the pulse P from the RGB switching control circuit 3 is in "L" state, so that the output terminals OG1 to OBi are connected to the input terminals IG1 to IBi, respectively, as shown by the timing (e) in FIG. 3. In such case, the switches of the switch circuit 9, which correspond to the output terminals OGi+1 to OBn in the second half of the scan line, are OFF, so that the output terminals OGi+1 to OBn are not connected to the input terminals IGi+1 to IBn. The pulse P becomes "H" in the second half of the write period T, during which the output terminals OGi+1 to OBn are connected to the input terminals IGi+1 to IBn and the output terminals OB1 to OBi are not connected to the input terminals IG1 to IBbi.

In this embodiment, the switch circuit 9 is provided between the output terminals OG1, OR1, OB1, . . . , and the input terminals IG1, IR1, IB1, . . . , shown in FIG. 1 as mentioned. During the first half of the write period T, the switch circuit 9 connects the output terminals of the first half of the horizontal scan line to the capacitors C of the respective R, G and B pixel circuits of the first half of the horizontal scan line and, during the second half of the write period T, connects the output terminals of the second half of the horizontal scan line to the capacitors C of the respective R, G and B pixel circuits of the second half of the scan line.

On the other hand, as shown by waveforms (a), (b) and (c) in FIG. 3, each of the switch control signals Sr, Sr and Sb takes in the form of two "H" level pulses each T/6 wide with period of T/2 during the write period T.

As a result, after the drive current values are written in the R, G and B OEL elements 4*a* for one horizontal scan line, the drive for light emission is performed as shown by a timing (d) in FIG. 3 such that the G, R and B OEL elements 4*a* of the pixel circuits 4G1, 4R1, 4B1, 4G2, 4R2, 4B2, . . . , of the one scan line emit lights simultaneously.

Incidentally, although the write is performed twice during the write period T by closing the switches connected to the first half of output terminals and then closing the switches connected to the second half output terminals in FIG. 4, it is of course possible to divide the output terminals to be horizontally scanned by m (where m is an integer equal to or larger than 2) and perform the write m times during the write period T.

In the described embodiment, the current switch circuit is constructed with the N channel transistors Tr5 and Tr7 with drains thereof being connected together and the drive current is supplied to the drains commonly. However, the construction thereof is not limited thereto. For example, it is possible to perform a current switching by connecting sources of P channel transistors together. Alternatively, bipolar transistors may be used. That is, the current switching operation is performed according to ON/OFF operation of transistors or diodes.

Further, although the current switch circuits 11*g*, 11*r* and 11*b* of the described embodiments are provided externally of the pixel circuits of the organic EL display panel, the current switch circuits may be integrated within the organic EL display panel similarly to the pixel circuits.

Although the embodiments of the present invention are constructed with MOS FETs mainly, it may be constructed with bipolar transistors. Further, the N channel type (or NPN type) transistors may be replaced by P channel type (or PNP type) transistors and the P channel type transistors may be replaced by N channel type (or NPN type) transistors. In such case, the power source voltage should be negative and the transistors provided on the upstream side should be provided on the downstream side.

What is claimed is:

1. A drive circuit of an active matrix type organic EL display panel including a plurality of pixel circuits provided correspondingly to respective red, green and blue display colors, each said pixel circuit having an organic EL element, a capacitor for storing a voltage value corresponding to a drive current of said organic EL element and a transistor for supplying the drive current to said organic EL element, said drive circuit comprising:

a drive current generator circuit for generating drive currents corresponding to the red, green and blue colors in a predetermined sequence in response to a RGB switching signal; and a current switching circuit having a first, second and third output terminals corresponding to the respective red, green and blue colors, said current switching circuit adapted to select one of said first, second and third output terminals in the predetermined sequence in response to the RGB switching signal, generate currents for charging said capacitors of said pixel circuits for the red, green and blue colors in response to the drive currents and output the charging current to said output terminals.

2. A drive circuit of an active matrix type organic EL display panel, as claimed in claim 1, wherein said current switching circuit includes a first, second and third current switch circuits provided corresponding to the drive currents, the RGB switching signal includes a first, second and third control signals generated in the predetermined sequence, said first current switch circuit performs a current switching operation in response to the first control signal to output a current corresponding to the drive current from said drive current generator circuit to said first output terminal as the charging current, said second current switch circuit performs a current switching operation in response to the second control signal to output a current corresponding to the drive current from said drive current generator circuit to said second output terminal as the charging current and said third current switch circuit performs a current switching operation in response to the third control signal to output a current corresponding to the drive current from said drive current generator circuit to said third output terminal as the charging current.

3. A drive circuit of an active matrix type organic EL display panel, as claimed in claim 2, wherein the RGB switching signal is generated during a write period for storing the voltage value current in said capacitor.

4. A drive circuit of an active matrix type organic EL display panel, as claimed in claim 3, wherein the charging current is pulled from sad pixel circuit to said selected output terminal and a plurality of said drive circuit are provided correspondingly in number to red, green and blue pixels in a horizontal scan direction, each said drive circuit being provided for a red, green and blue pixels.

5. A drive circuit of an active matrix type organic EL display panel, as claimed in claim 3, wherein said drive current generating circuit includes a register for storing data for generating the drive current correspondingly to the red, green and blue colors and a D/A converter circuit for D/A converting data corresponding to the red, green and blue colors according to the first, second and third control signals from said register to generate the drive current in the predetermined sequence, said first, second and third current switching circuits are connected to said pixel circuits through data electrodes, respectively.

6. A drive circuit of an active matrix type organic EL display panel, as claimed in claim 5, wherein each of said first, second and third current switching circuits includes a first current mirror circuit and a first transistor provided in parallel to an input side transistor of said first current mirror circuit, the drive current from said D/A converter circuit is supplied to said input side transistor and said first transistor and a current switching is performed between said input side transistor and said first transistor according to an ON/OFF operation of said first transistor.

7. A drive circuit of an active matrix type organic EL display panel, as claimed in claim 6, further comprising a data selector circuit, wherein said data selector circuit selects red, green and blue color data from said register according to the first, second and third control signals and sends it to said D/A converter circuit and said first transistors of said first, second and third current switching circuits are turned ON or OFF by the first, second and third control signals, respectively.

8. A drive circuit of an active matrix type organic EL display panel as claimed in claim 7, wherein said current switching circuit includes a second current mirror circuit having an input side transistor and output transistors corresponding to the red, green and blue colors, said input side transistor of said second current mirror circuit receives the drive current from said D/A converter circuit and sends the drive current to said first current mirror circuits of said first, second and third current switching circuits through said output transistors.

9. A drive circuit of an active matrix type organic EL display panel, as claimed in claim 6, further comprising a switch control circuit for generating the first, second and third control signals, wherein the charging currents for charging said capacitors corresponding in number to red, green or blue pixels in the horizontal scan direction are generated simultaneously.

10. A drive circuit of an active matrix type organic EL display panel, as claimed in claim 6, wherein said output terminals to be horizontally scanned is divided by m and the write is performed m times in the write period, where m is an integer equal to or larger than 2.

11. A drive circuit of an active matrix type organic EL display panel, as claimed in claim 1, wherein said current switching circuit selects the drive currents and the first to third output terminals in a predetermined sequence according to the R, G and B switching signals as the RGB switching signal, generates currents for charging capacitors of respective R, G and B pixel circuits and outputs the current to the sequentially selected output terminal.

12. A drive circuit of an active matrix type organic EL display panel, as claimed in claim 11, wherein said current switching circuit includes a first, second and third current switch circuits provided corresponding to the drive currents, the RGB switching signal includes a first, second and third control signals generated in the predetermined sequence, said first current switch circuit performs a current switching operation in response to the first control signal to output a current corresponding to the drive current from said drive current generator circuit to said first output terminal as the charging current, said second current switch circuit performs a current switching operation in response to the second control signal to output a current corresponding to the drive current from said drive current generator circuit to said second output terminal as the charging current and said third current switch circuit performs a current switching operation in response to the third control signal to output a current corresponding to the drive current from said drive current generator circuit to said third output terminal as the charging current.

13. A drive circuit of an active matrix type organic EL display panel, as claimed in claim 12, wherein the RGB switching signal is generated during a write period for storing the voltage value current in said capacitor.

14. An organic EL display device comprising said drive circuit of said active matrix type organic EL display panel, as claimed in claim 1.

15. An organic EL display device as claimed in claim 14, further comprising said active matrix type organic EL display panel and a controller, wherein said switching signal generator circuit is controlled by said controller.

* * * * *